United States Patent [19]

Miller et al.

[11] 4,379,508

[45] Apr. 12, 1983

[54] NESTING TRAY WITH STACKING KEYED INTERLOCK

[75] Inventors: Daniel R. Miller, Cincinnati; Thomas Deaton, Mason; Robert Royer, Cincinnati, all of Ohio

[73] Assignee: Nestier Corporation, Cincinnati, Ohio

[21] Appl. No.: 311,376

[22] Filed: Oct. 14, 1981

[51] Int. Cl.[3] ..... B65D 21/04

[52] U.S. Cl. ..... 206/507

[58] Field of Search ..... 206/505, 506, 507

[56] References Cited

U.S. PATENT DOCUMENTS

| | | | |
|---|---|---|---|
| 3,392,875 | 7/1968 | Bockenstette | 206/507 |
| 3,675,815 | 7/1972 | Rehrig | 206/507 |
| 4,093,071 | 6/1978 | Stahl et al. | 206/507 |
| 4,106,624 | 8/1978 | Thurman | 206/507 |
| 4,189,052 | 2/1980 | Carroll et al. | 206/507 |
| 4,343,800 | 8/1982 | Faucillon | 206/507 |

FOREIGN PATENT DOCUMENTS

| | | | |
|---|---|---|---|
| 2805880 | 2/1979 | Fed. Rep. of Germany | 206/507 |

*Primary Examiner*—George E. Lowrance

*Attorney, Agent, or Firm*—Thomas E. Beall, Jr.

[57] ABSTRACT

Each tray in a plurality of 90 degree nestable and stackable trays is formed with a specific key portion along the upper edge of the end walls and a corresponding specific groove and web structure along the lower edge of the end walls. A first group of trays has a specific key structure different from a second group of the trays, each group of trays having its own key structure. Trays of a first group cannot be stacked in vertical alignment with trays of the second group, since the key structure of the first group is adapted to be received by the web structure of the first group, and not by the web structure of the second group, and vice versa.

8 Claims, 4 Drawing Figures

NESTING TRAY WITH STACKING KEYED INTERLOCK

FIELD OF THE INVENTION

This invention relates to trays and more particularly to trays of a one piece construction of molded synthetic resin material. Such trays are used for bakery goods and the like.

BACKGROUND OF THE INVENTION

Nestable and stackable trays of single piece construction are known in the art. An example of such a tray is shown in the Bockenstette U.S. Pat. No. 3,392,875. The Bockenstette patent shows a nestable and stackable tray for bakery goods having posts spaced along the side walls which are shorter than the end walls to prevent the goods from sliding out of the tray while permitting inspection of them. Another Bockenstette U.S. Pat. No. 3,819,044 shows a tray of one piece construction having inner and outer parallel top stacking rails as well as inner and outer parallel bottom stacking rails. This later Bockenstette patent also features 90 degree nesting and stacking.

The Herolzer U.S. Pat. No. 3,780,905 shows a stackable nestable bakery tray with improved upper and lower stacking rails. The bottom stacking rail has floor engaging structures on opposite sides providing for a recess of a size able to receive a hand truck or the like. The Rehrig U.S. Pat. No. 3,675,815 shows a bakery tray which is molded from a single homogeneous mass of thermoplastic material. The end walls and side walls include means facilitating filling of the tray with packages of bakery products. The Thurman U.S. Pat. No. 4,106,624 shows a tray structure which is designed for nesting and stacking. Top, middle, and bottom rib and rail structures cooperate with the trays walls to prevent end-to-end as well side-to-side movement of the upper tray relative to the lower tray when the trays are in stacked, as well as in nested, relationship with one another. The Stahl U.S. Pat. Nos. 4,093,070 and 4,093,071, both show bakery trays of a single piece molded construction, and both are stackable and nestable type trays.

SUMMARY OF THE INVENTION

The stacking nesting feature of the prior art trays allows for the delivery of a vertical stack of trays and the subsequent return of a shorter stack of the same trays transported in a nested relationship. In the transportation of baked goods, these types of trays are used very frequently. Some bakeries may use only one type of tray to transport all of their baked goods. At locations where more than one bakery's goods are being received a problem arises if two or more bakeries are using the same trays to transport their goods. At these locations one bakery may lose any number of trays to another bakery because there is no way to prevent one bakery from using another bakery's trays if both bakeries own identical prior art type trays.

By this invention, there is provided groups of trays which could be sold to separate companies which are of the same configuration and shape. However, there is provided trays of one group constructed according to this invention which are not stackable with trays of another group constructed according to this invention. Therefore tray manufacturing companies could produce such trays which have all the advantages of nesting, stacking and the like and at the same time offer these trays to different and competing bakeries or companies. The competing bakeries would then have the security of knowing that the trays they use have been specifically modified so that they are not stackable with seemingly identical trays which would belong to another bakery. Furthermore, groups of trays constructed according to this invention could be inexpensively mass produced with only slight modifications to the molding equipment used to produce the trays. Therefore it is an object of this invention to provide bakery trays of the nestable and stackable type which are easily and inexpensively produced, and yet provide each group of trays constructed according to this invention with stacking structures which do not allow for the interchanging of a tray of one group with a tray of another group when the trays are to be stacked vertically.

These and other objects of the present invention will become more apparent during the course of the following detailed description and appended claims.

BRIEF DESCRIPTION OF THE DRAWINGS

The invention may be best understood with reference to the accompanying drawings wherein an illustrated embodiment of the invention is shown. In the drawings.

The trays of this invention are of the type shown in the Bockenstette patent 3,392,875 which is herein incorporated by reference. The bottom wall of the container is of the type shown in the Bockenstette patent. All of the details of the tray of this invention not herein described are of the type shown in the Bockenstette patent.

Figure 1:
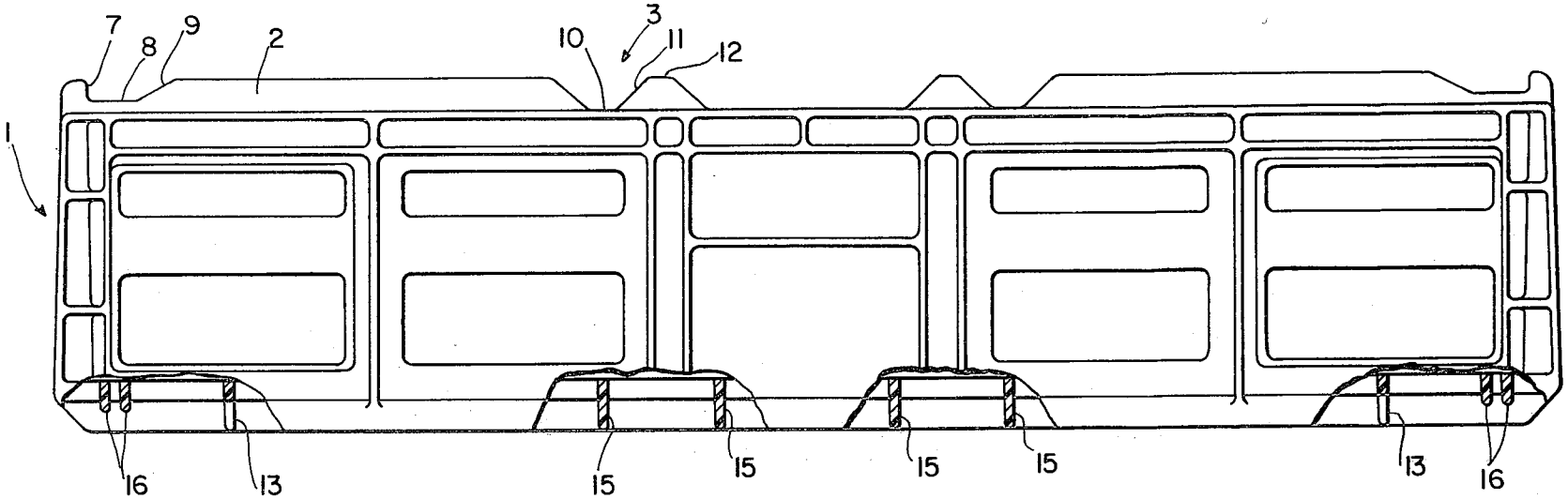
FIG. 1 shows the end view of one tray of a first group of trays constructed according to this invention.
Figure 2:
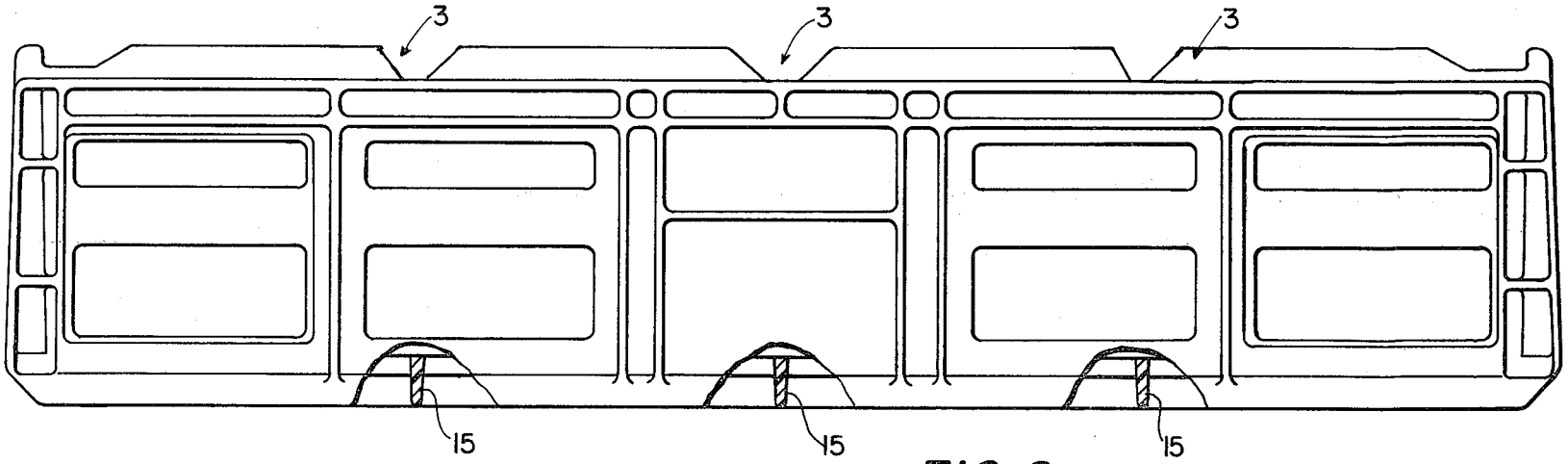
FIG. 2 shows the end view of one tray of a second group of trays constructed according to this invention.

An end wall 1 of a tray constructed according to this invention is shown in FIG. 1. Along the upper edge of the end wall is a ridge 2 which is molded integrally with the end wall. The ridge 2 has notches or cutout portions 3 cut into the full depth of the ridge. The pattern of notches 3 along the ridge creates a key structure. Any number of different key structures could be created by varying the position of the notches 3. In FIG. 2 the containers shown are identical to the containers shown in FIG. 1 except the key structure or placement of the notches 3 along the ridge 2 is different from that of the key structure shown in FIG. 1. The significance for the difference in the key structures for otherwise identical containers constructed according to this invention will be more fully described later.

The trays constructed according to this invention are adapted to be stacked and nested. In stacking, end walls of adjacent like containers engage to form the vertical stack. At the lower end of the end walls, FIG. 3, a lock groove 4 can be seen. Within the groove 4 are webs of varying depths positioned and dimensioned to accommodate corresponding portions of the ridges of an adjacently stacked lower container. Additionally there is provided an inner upper stacking rail 5 parallel to the ridge which is received within an inner lower stacking groove 6.

The ridge 2 of each of the containers shown in both FIGS. 1 and 2 is further characterized by opposed stop surfaces 7, middle ridge surfaces 8, and ridge cam surfaces 9. A lower ridge surface 10, which coincides with the bottom of notches 3 has two opposed upwardly sloping notch cam surfaces 11 extending outwardly to an upper ridge surface 12.

Figure 3:
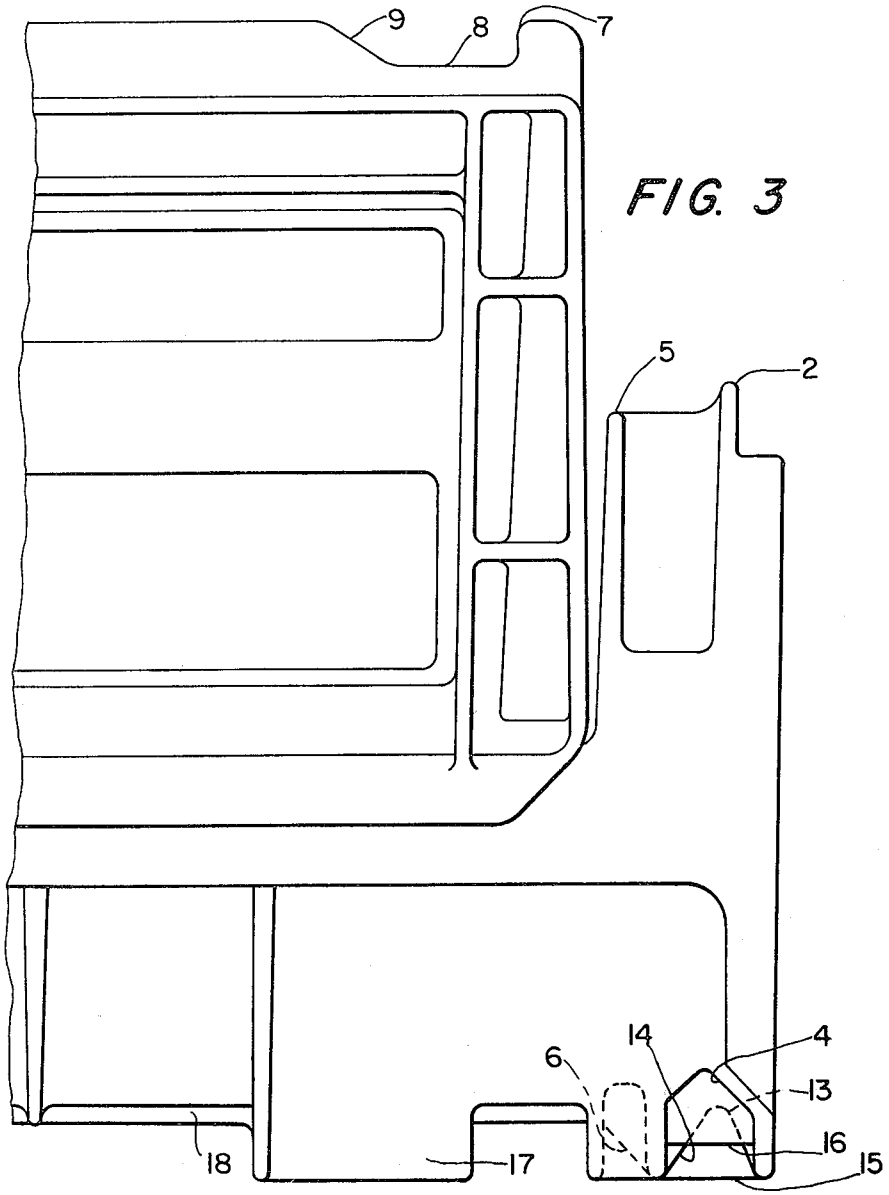
FIG. 3 is a side elevational view of the trays shown in FIGS. 1 and 2 in nested relation.

Positioned within the groove 4 are webs of varying depths. The lower depth cam web 13 as can be seen in FIG. 3 has a substantially inverted V-shaped cross section. The legs of the V are web cam surfaces 14 and extend from the depth of the web outwardly to the opening of the groove 4. Another web type positioned within the groove is the full depth latch web 15. Web 15 extends completely across the groove 4 so as to be flush with the groove's opening edges. A middle depth web 16 is also positioned within the groove. The top portion of web 16 extending across the groove is parallel to the portion of web 15 which extends across the mold groove opening. The positioning of at least the web 15 within the groove of a particular tray is dependent upon the key structure of that particular tray. The full depth webs 15 of one group of trays are aligned vertically beneath the notches 3 of the same group of trays as can be seen in the cutaway along the lower edge of the end wall shown in FIGS. 1 and 2. The middle depth webs 16 are aligned vertically beneath the opposed middle ridge surfaces 8 as can be seen in the cutaway shown in FIG. 1. The lower depth webs 13 can be positioned at any points along the groove which are vertically aligned beneath the upper ridge surfaces 12. A cross sectional view of webs 13 can be seen in the cutaway shown in FIG. 1. Since the trays of FIG. 2 are identical with the trays of FIG. 1 except for the positioning of the notches or key structure of the ridge 2 and the corresponding positioning of the full depth webs 15, only the full depth webs 15 are shown, in cutaway, to show the vertical alignment of the webs 15 with the notches 3 for that group of trays.

It can be seen that the ridge 2 and inner stacking rail 5 of one group of trays for example having a key structure as shown in FIG. 1 will be seated within the groove 4 and inner lower stacking groove 6 respectively of an adjacent stacked tray having the same key structure. In the stacking of trays having the same key structure and therefore the same positioning of the webs 13, 15, and 16 an initial off-centering between one tray relative to another is corrected by the camming action between the webs 13, 15, and 16 and the cam surfaces 9, 11, and 14. The ridge cam surfaces 9 act with the middle depth webs 16 to center adjacent stacked trays in a direction parallel to the ridge. Additionally notch cam surfaces 11 act with full depth latch webs 15 to center adjacent stacked trays in the same direction. Web cam surfaces 14 on lower depth webs 13 act with upper ridge surfaces 12 to center adjacent stacked trays in a direction perpendicular to the ridge. This camming action provides for the full seating of all the portions of ridge 2 within the groove 4 of an adjacent tray in a vertically aligned stack. The full seating of the ridge within the groove acts to telescopingly interlock stacked containers. Shifting of the trays when stacked is prevented by this telescoping interlocking in directions parallel to and perpendicular to the end walls.

For each adjacent stacked tray having the same key structure and therefore the same corresponding web positioning the ridge of one tray is fully seated within the groove of an upper adjacent tray. However, if trays which have different key structures and therefore different positioning of at least the webs 15 in the groove are stacked together vertically, then the ridge of the lower tray having one kind of key structure is not fully seated within the groove of another upper tray, because the upper tray would have a different web positioning that corresponds with a different key structure. Therefore, identical trays constructed according to this invention having different key structures such as the trays shown in FIG. 1 and FIG. 2 cannot be interchangeably stacked together and if inadvertently tried, the stacker would immediately be aware of the problem.

In FIG. 3 it is shown how the containers can be nested when one container is rotated 90 degrees about an axis perpendicular to the bottom wall of the tray with respect to the other tray. Because of the identical structure of the containers constructed according to this invention, the particular key structure of a tray does not affect the nesting of trays having different key structures.

Figure 4:
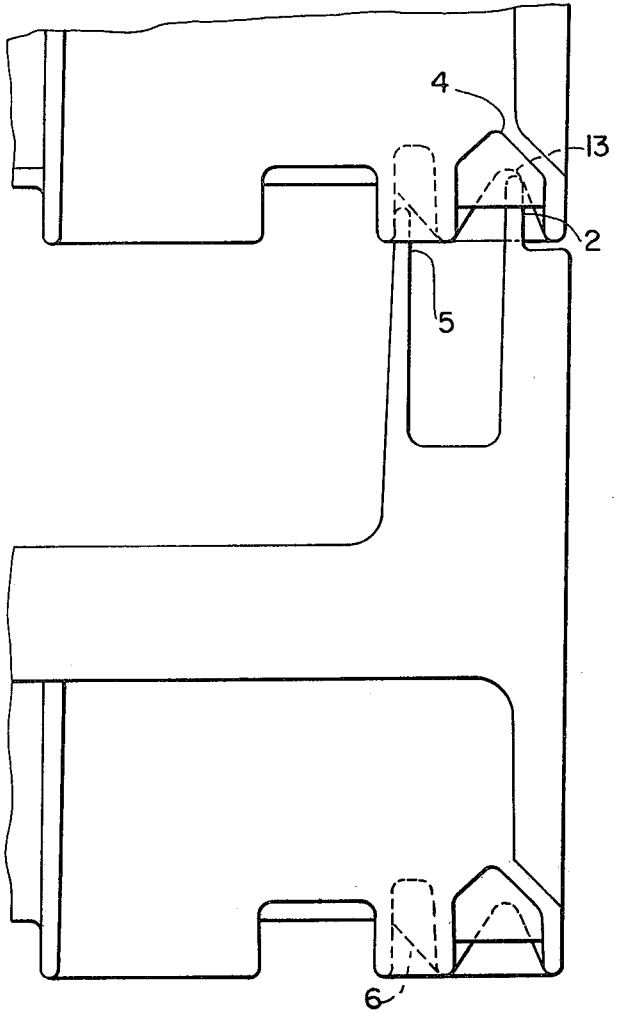
FIG. 4 is a side elevational view showing two like trays vertically stacked together.

In FIGS. 3 and 4 like portions 17 can be seen which extend below bottom wall 18 of the tray a sufficient distance to provide for a depth between the surface upon which the tray rests and the bottom wall such that a hand truck could be slipped in that space. Additionally the leg portions 17 are spaced far enough oppositely from each other such that the width of the space could accommodate a hand truck.

I claim:

1. A plurality of trays, comprising:

each tray being of a one piece construction molded from synthetic resin material, having a rectangular structure, parallel opposed side walls, a bottom wall and parallel opposed end walls, said side walls and said end walls extending vertically upward from said bottom walls, said end walls having a height greater than said side walls, and said end walls having free upper and lower edges:

said side walls and said end walls having surface means formed thereon for enabling said trays to be stacked in a vertically aligned position, and for enabling said trays to be stacked in a nested position when one of said trays is rotated at least 90 degrees relative to another of said trays about an axis perpendicular to said bottom walls from said stacked position;

said surface means including upper stacking elements formed integrally with said end walls extending along said upper edges of said end walls, and lower stacking elements formed integrally with said end walls at said lower edges of said end walls;

one of said upper and lower stacking elements comprising a ridge and the other of said upper and lower stacking elements comprising groove means wide enough and deep enough to receive said ridge;

web means extending across the width of said groove means for preventing the seating in said groove means of portions of said ridge which are vertically aligned with said web means when said upper and said lower stacking elements of adjacent stacked trays engage;

said ridges including notches having dimensions that correspond with the dimensions of said web means such that the engagement of said web means within said notches permits the seating of said ridge within said groove means of adjacent stacked trays;

a first plurality of said trays being identical and having a unique pattern of said web means and corresponding said notches of said upper and said lower stacking elements so that when said first plurality of said trays are stacked on and vertically aligned with one another each of said web means will be received within a notch of the adjacent tray;

a second plurality of said trays being identical to each other and differing from said first plurality of said trays substantially only in having a second unique pattern of said web means and corresponding said notches of said upper and said lower stacking elements so that when said second plurality of said trays are stacked on and vertically aligned with one another each of said web means will be received within a notch of the adjacent tray; and said first plurality of said trays unique pattern having a difference between said second plurality of said trays unique pattern such that said difference prevents the seating of said ridge of any one of said first plurality of said trays within said groove means of any one of said second plurality of said trays.

2. A plurality of trays, comprising:

a single piece construction molded from synthetic resin material having a generally rectangular shape and having a bottom wall, parallel opposed side walls, and parallel opposed end walls, said end walls having upper and lower edges, said side walls and said end walls being substantially vertical and perpendicular to said bottom wall, said end walls being greater in height than said side walls;

said side walls and said end walls having surface means formed thereon for enabling said trays to be stacked in a vertically aligned position, and for enabling said trays to be stacked in a nested position when one of said trays is rotated at least 90 degrees relative to another of said trays about an axis perpendicular to said bottom walls from said stacked position;

upper stacking elements formed integrally with one of said end and said side walls and extending along said upper edge of that one of said walls, and lower stacking elements formed integrally with one of said walls at said lower edge of that one of said walls;

key means on one of said stacking elements and groove means on the other of said stacking elements providing for the telescoping interlocking of said upper and said lower stacking elements of a first plurality of said trays when stacked in vertical alignment on one another and said key means and said groove means providing for the telescoping interlocking of said upper and said lower stacking elements of a second plurality of said trays when stacked in vertical alignment on one another;

said key means cooperting with said groove means to prevent the shifting between said trays of said first plurality when said trays of said first plurality are aligned in a vertical stack and said key means cooperating with said groove means to prevent the shifting between said trays of said second plurality when said trays of said second plurality are aligned in a vertical stack, in directions parallel to and perpendicular to said end walls; and said first plurality of said trays being substantially identical to and differing only from said second plurality of said trays in that said key means cooperating with said groove means acts to prevent the stacking with telescoping interlocking of said trays of said first plurality with said trays of said second plurality.

3. The trays according to claim 2, wherein said stacking elements further comprise:

a ridge on one of said stacking elements, and said groove means on the other of said stacking elements dimensioned to telescopingly receive said ridge;

webs extending across said groove means so as to prevent the seating of said ridge within said groove means when one of said stacking elements of one tray engages with the other of said stacking elements of another tray in a vertically aligned stack;

notches along said ridge for each of said first and said second plurality of said trays which are spaced so as to be vertically aligned with said webs so as to permit the seating of the rest of said ridge within the portions of said groove means that do not have said webs extending across said groove means for adjacent stacked trays and so as not to be vertically misaligned in a vertically aligned stack.

4. The trays according to claims 1 or 3, wherein said end walls further comprise an inner upper stacking rail integrally formed with said end wall extending along said upper edge parallel to and spaced from said ridge;

an inner lower stacking groove integrally formed with said end walls and having outer and inner side walls;

said inner upper stacking rail of any of said trays being engageable with said lower inner stacking groove of any other of said trays when any of said trays are stacked on and vertically aligned with one another in a vertical stack.

5. A tray according to claim 1 or 2, wherein said side walls further have leg portions spaced closely near said opposed end walls and extending downwardly so as to be flush with the downwardmost extension of the said lower stacking elements;

said leg portions being spaced apart from each other to provide a space having a width sufficient to accommodate a hand truck; and said leg portions further dimensioned in depth so as to provide a vertical space between said bottom wall and a surface upon which said trays rest sufficient to accommodate a hand truck.

6. The trays according to claim 1 or 2, wherein said end walls further comprise:

opposed substantially vertical stop surfaces formed integrally with said end walls, at the upper edge of said end walls, and formed at the corners of said trays.

7. The trays according to claim 6, wherein said ridge further comprises at least two middle ridge surfaces adjacent to each of said stop surfaces, at least two cam surfaces adjacent to each of said middle ridge surfaces, said cam surfaces sloping upwardly from each of said middle ridge surfaces to at least two upper ridge surfaces, at least one lower ridge surface forming the bottom of said notches, and opposed upwardly sloping notch cam surfaces extending from said lower ridge surface to said upper ridge surfaces.

8. The trays according to claim 7, wherein said web means includes:

full depth webs extending fully across said groove means and extending the full depth of said groove means, middle depth webs extending fully across said groove means and extending only half the depth of said groove means, and lower depth webs of substantially V-shaped cross section, said lower depth webs having web cam surfaces extending from the opening of said groove means to the full depth of said lower depth web;

said full depth webs being positioned in said groove means to engage with the intersections of said lower ridge surfaces and said notch cam surfaces, said middle depth webs positioned in said groove means to engage with the intersections of said ridge cam surface and said middle ridge surface and positioned to engage with the intersection of said middle ridge surface with said stop surface, and said lower depth webs positioned along said groove means so as to receive said upper ridge surfaces; and said web cam surfaces engaging with said upper ridge surfaces to align said upper ridge surfaces of one of said trays within said lower depth webs of another of said trays stacked in vertical alignment adjacent one another in a direction perpendicular to said ridge, and said notch cam surfaces of one of said trays engaging said full depth webs of another of said trays when said trays are stacked adjacent one another in a vertically aligned stack acting to align trays in a direction parallel to said ridge, and said ridge cam surfaces of one of said trays acting with said middle depth webs of another of said trays stacked adjacent one another in a vertically aligned stack to additionally provide for centering of said tray relative to the other of said trays in a direction parallel to said ridge.

* * * * *